US009988255B2

(12) United States Patent
Clüsserath et al.

(10) Patent No.: US 9,988,255 B2
(45) Date of Patent: Jun. 5, 2018

(54) FILLING SYSTEM AND FILLING MACHINE

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 304 days.

(21) Appl. No.: 14/770,281

(22) PCT Filed: Jan. 17, 2014

(86) PCT No.: PCT/EP2014/000124
§ 371 (c)(1),
(2) Date: Aug. 25, 2015

(87) PCT Pub. No.: WO2014/127880
PCT Pub. Date: Aug. 28, 2014

(65) Prior Publication Data

US 2016/0009535 A1 Jan. 14, 2016

(30) Foreign Application Priority Data

Feb. 25, 2013 (DE) ..... 10 2013 101 812
Feb. 25, 2013 (DE) ..... 10 2013 101 813

(51) Int. Cl.

| | |
|---|---|
| ***B65B 43/42*** | (2006.01) |
| ***B67C 3/22*** | (2006.01) |
| ***B67C 3/24*** | (2006.01) |
| ***B67C 3/26*** | (2006.01) |

(52) U.S. Cl.
CPC ..... *B67C 3/225* (2013.01); *B67C 3/244* (2013.01); *B67C 3/2634* (2013.01); *B67C 2003/228* (2013.01)

(58) Field of Classification Search
CPC ..... B67C 3/225; B67C 3/2634; B67C 3/244; B67C 2003/228
See application file for complete search history.

(56) References Cited

U.S. PATENT DOCUMENTS

2005/0284731 A1 12/2005 Hartness

FOREIGN PATENT DOCUMENTS

| | | |
|---|---|---|
| DE | 487 827 | 12/1929 |
| DE | 20 2005 007 446 | 12/2005 |
| DE | 10 2006 017 706 | 10/2007 |
| DE | 10 2008 008 945 | 8/2009 |
| DE | 10 2010 032 573 | 2/2012 |
| DE | 10 2010 032573 | 2/2012 |
| DE | 10 2011 111 483 | 2/2013 |
| EP | 0 810 180 | 12/1997 |

*Primary Examiner* — Jason K Niesz
(74) *Attorney, Agent, or Firm* — Occhiuti & Rohlicek LLP

(57) ABSTRACT

An apparatus for processing containers includes a container-filling system having filling-point pairs in which each filling point has a filling element. Each filling element has a channel formed in a housing, a liquid valve in the channel that controls flow through a dispensing opening. The filling system also has internal and external gas-paths that are internal and external relative to the filling elements. These gas paths connect to each other. A gas-path control-valve controls the external path. Nothing controls the internal path. A stand-alone control module contains part of the external gas-path and the gas-path control-valve.

18 Claims, 7 Drawing Sheets

FILLING SYSTEM AND FILLING MACHINE

RELATED APPLICATIONS

This application is the national stage under 35 USC 371 of PCT/EP2014/000124, filed on Jan. 17, 2014, which claims the benefit of the Feb. 25, 2013 priority dates of German applications 102013101812.2 and 102013101813.0 the contents of which are herein incorporated by reference.

FIELD OF INVENTION

The invention relates to container processing, and in particular, to filling containers with liquid.

BACKGROUND

It is known to have a filling system that has a plurality of filling points. Each filling point has a filling element and a container holder. The container-holder holds the container so that it is sealed against the filling element during filling. These systems implement many different filling methods, such as open jet filling, vacuum filling, and pressurized filling. It is also known to provide controlled gas paths in the filling elements or in their filling-element housings. Especially with pressure filling, it is essential to hold the containers in a sealed position on the filling element, i.e. pressed against the container carrier by a lifting device. This occurs not only during a filling phase, in which the liquid contents flow to the relevant container, but also in at least one process phase preceding this filling phase, for example to pretension the container interior with pressure.

SUMMARY

In one aspect, the invention features an apparatus for processing containers. Such an apparatus includes a filling system for filling containers with liquid filling-material. The filling system has filling-point pairs, each of which includes filling points. Each filling point includes a filling element, and each filling element includes a filling-element housing, a liquid valve, and a liquid channel formed within the housing. The liquid channel has a dispensing opening at an end thereof for dispensing the liquid filling-material into a container. The liquid valve controls the dispensing by the dispensing opening. The filling system also includes, for each filling pair, a gas path, a gas-path control-valve, and a stand-alone control module that includes both part of the external gas-path and the gas-path control valve. The gas path has comprises two sections: an internal gas-path and an external gas-path. The internal gas-path is internal to a filling element, and the external gas-path is external to any filling element, and common to both filling elements in a filling-point pair. The gas-path control-valve is disposed along the external gas-path. The internal gas-path is connected to the gas-path control-valve.

Some embodiments include a transport element on which the filling elements and the control modules are mounted. The transport element conveys the filling elements along a first path having a first radius, and the control modules along a second path concentric to the first but having a second radius that is less than the first.

In other embodiments, the control module comprises a module housing. At least a section of the external gas-path is formed within the module housing. The gas-path control-valve is along the at least a section of the external gas-path.

Other embodiments include a transport element having an outer surface on which the filling elements are disposed and in which a section of the external gas-path with uncontrolled gas flow is formed. Among these are embodiments in which the section of the external gas-path that is formed on the transport element opens into internal gas-paths of multiple filling elements, and those in which the section of the external gas-path that is formed on the transport element opens into channels provided in the transport element, the channels being common to multiple filling elements.

Yet other embodiments include a transport element on which the control modules are arranged on an annular surface thereof.

Additional embodiments include those in which the external gas-path opens directly into the internal gas-path.

Still other embodiments include an external gas-path opening, an internal gas-path opening, and a seal having a cross-sectional area that is greater than either opening. In these embodiments, the external gas-path opening and the internal gas-path opening define an interface for fluid communication between the external gas-path and the internal gas-path. The seal then seals the interface.

Another embodiment includes a transport element that forms a partition that defines first and second regions, the second one being an aseptic space for sterile filling of liquid filling material into containers passing therethrough. Each of the filling elements comprises a first portion and a second portion, with the latter including the dispensing opening. Only the second portion extends into the aseptic space. The control module and gas-path control-valves are both disposed on the partition in the first region.

In other embodiments, the filling elements are spaced apart by a fixed distance, and both the control module and the filling elements are configured to be mounted on either a first rotor or a second rotor, with the two rotors having different pitch circles with radii that differ by no more than a specified non-zero value.

In another aspect, the invention features an apparatus for processing containers. The apparatus includes a container-filling system having filling-point pairs in which each filling point has a filling element. Each filling element has a channel formed in a housing, and a liquid valve in the channel that controls flow through a dispensing opening. The filling system also has internal and external gas-paths that are internal and external relative to the filling elements. These gas paths connect to each other. A gas-path control-valve controls the external path. Nothing controls the internal path. A stand-along control module contains part of the external gas-path and the gas-path control-valve.

In another aspect, the invention includes an apparatus in which the filling points of a filling system form filling-point pairs with common gas-path control-valves for the filling elements of each filling-point pair in gas paths that route process gas and/or a vacuum. In addition, they also form a common gas-path control-valve for the two filling points of each filling-point pair that is part of a stand-alone module that is connected to a gas path made in each filling element of the filling-point pair. The stand-alone module is a control module with an outer controlled gas path for each filling-point pair. One control module is provided for each filling-point pair.

These filling elements have internal gas-paths that are not controlled. This means that the filling elements themselves do not have any gas-path control-valves. The outer gas paths can also be made in partial sections in a common rotor element or ring for all the filling points. The common rotor element or ring has the same axis as the machine axis of a filling machine having the filling system.

This modular structure has considerable advantages. With it, the connection required between the filling points and an annular channel common to all the filling elements or a group of filling elements of a filling system is more easily established.

Furthermore, the modular structure allows control and/or actuation modules, and in particular the gas-path control-valves and/or the actuation elements, to be arranged outside an aseptic region so that only a partial length of each filling element, namely the partial length comprising the delivery opening, protrudes into the aseptic region.

The modular structure also allows different filler sizes or filler divisions to be made, i.e. a different number of filling-point pairs on rotors with the same filling elements and the same gas-path control-valves and/or pneumatic actuation elements. The adaptation to the particular filler division or to the division spacing then occurs solely by means of the rotor element in which the outer gas paths of all the filling-point pairs are in part formed.

The filling elements and the control module are preferably made so that the connection between the inner and the outer gas channels occurs at the same time that the filling elements are mechanically secured.

As used herein, "pressure filling" means a filling method in which the container to be filled lies in a sealed position against the filling element and generally is pre-tensioned before an actual filling phase, i.e. before a liquid valve is opened, by a controlled gas path formed in the filling element with a pressurization gas under pressure, such as an inert gas or carbon dioxide gas, which then, during filling, is increasingly forced out of the container interior by the liquid contents flowing into the container as a return gas, this being likewise through a controlled gas path formed in the filling element. Further treatment phases can precede this pre-tensioning phase, examples of which include evacuating and/or the purging the inside of the container with an inert gas, such as carbon dioxide gas, this being likewise carried out by using gas paths formed in the filling element.

As used herein, "free-jet filling" means a process in which the liquid contents flow into the container to be filled in a free filling jet, wherein the container mouth or opening of the container does not lie against the filling element, but is at a distance from the filling element or from a contents outlet there. A salient feature of free-jet filling is that the air forced out of the container during the filling process by the liquid contents does not return to the filling element or to an area or channel formed therein that conveys gas. Instead, it flows freely out into the environment.

As used herein, "pitch circle" means a circle enclosing a vertical machine axis on which the filling elements of the filling system or of the filling machine are arranged.

As used herein, the expressions "substantially" or "approximately" mean variations from an exact value by ±10%, preferably by ±5% and/or variations that are insignificant for the function.

Further developments, benefits and application possibilities of the invention also arise from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE FIGURES

The invention is explained in more detail below by means of the figures using examples of embodiments. The following are shown.

DETAILED DESCRIPTION

Figure 1:
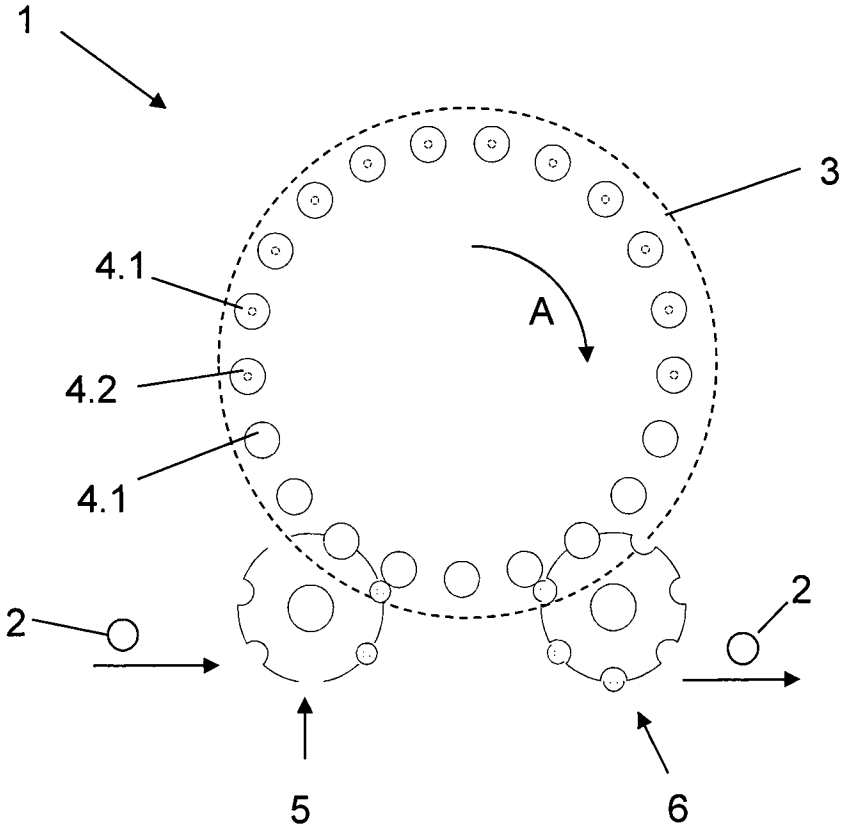
FIG. 1 shows a plan view of a rotary filling-machine for filling containers with liquid filling material, such as beverages.

FIG. 1 shows a rotary filling-machine 1 for filling bottles 2 with liquid filling-material. The filling machine 1 comprises a rotor 3 that rotates about a vertical machine axis MA passing through its center. The rotor's pitch circle has first and second filling points 4.1, 4.2 disposed thereon. The center of the pitch circle is the machine axis MA. The distance between two adjacent filling points is a "pitch distance." In the illustrated embodiment, all pitch distances are the same.

The first and second filling points 4.1, 4.2 are formed in such a way that, in the direction of rotation A of the rotor 3, every second filling point 4.2 is adjacent to and between two first filling points 4.1. Empty bottles 2 arrive at the filling machine 1 through a container inlet 5 and leave as filled bottles 2 through a container outlet 6.

The filling points 4.1, 4.2 are configured for different filling methods. One method is pressurized filling of bottles 2. Pressurized bottle filling includes pre-tensioning a bottle's interior with a pressurized process gas or inert gas, such as $CO_2$ gas. It can also include purging the bottle's interior one or more times with a process gas or an inert gas. Pressurized bottle filling can also include evacuating the bottle's interior, rapid or slow filling of the bottle, and pressure-relief of the bottle's interior after filling. These process steps are controlled in part by gas-path control-valves in gas paths of the filling points 4.1, 4.2.

Figure 2:
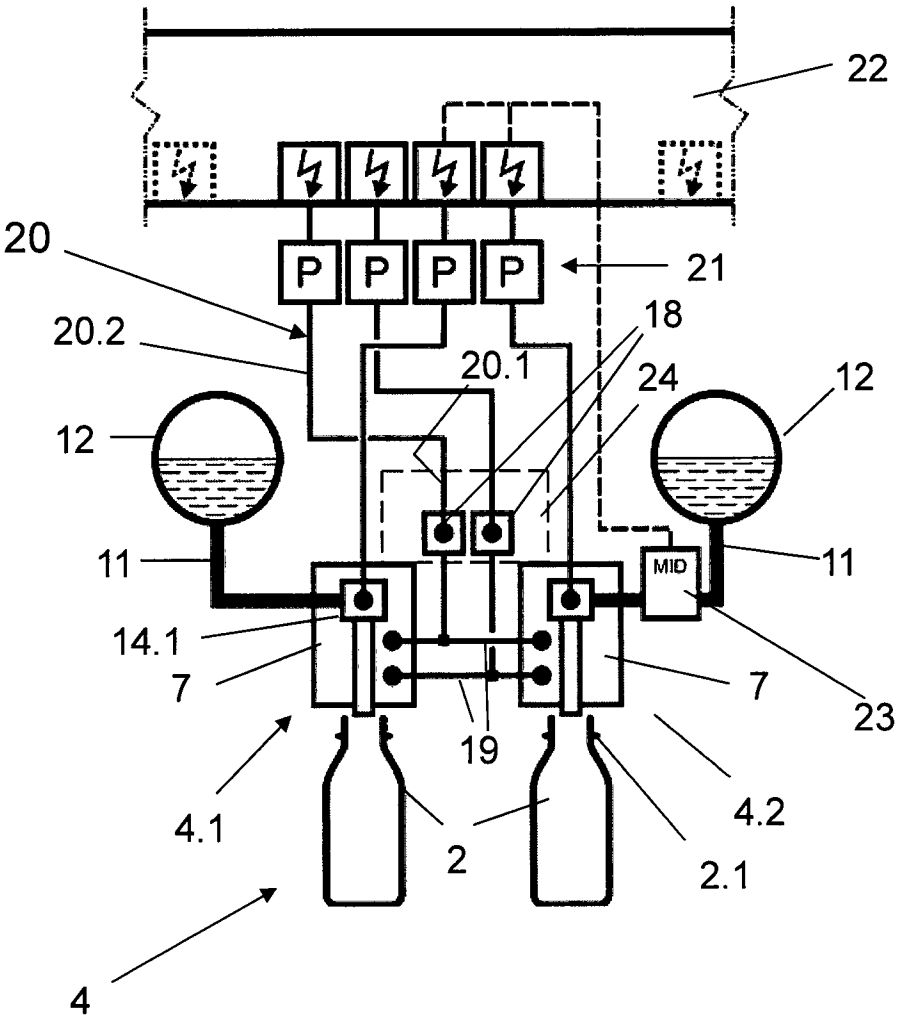
FIG. 2 shows a pair of filling points of the filling machine of FIG. 1.

As shown in FIG. 2, each filling point 4.1, 4.2 has one filling element 7 and a container carrier. The container carrier is a conventional one that suspends a bottle 2 from its opening flange 2.1 and that presses the bottle's mouth against the underside of the filling element 7 during the filling process. The container carrier is a conventional feature whose detailed illustration is not essential for a proper understanding of the invention. Accordingly, it has been omitted from the drawing.

Figure 4:
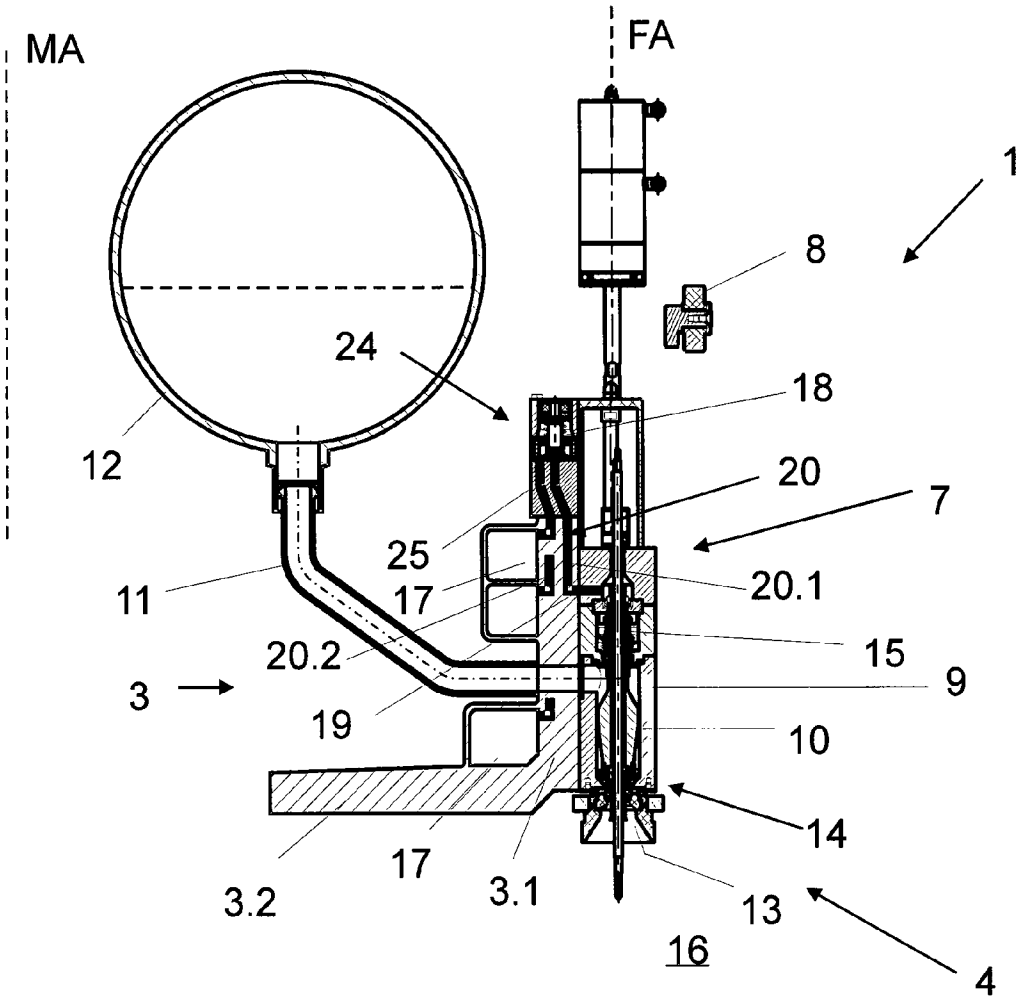
FIG. 4 is a section through a rotor and through one of the filling elements of a filling-point pair in FIG. 3.
Figure 5:
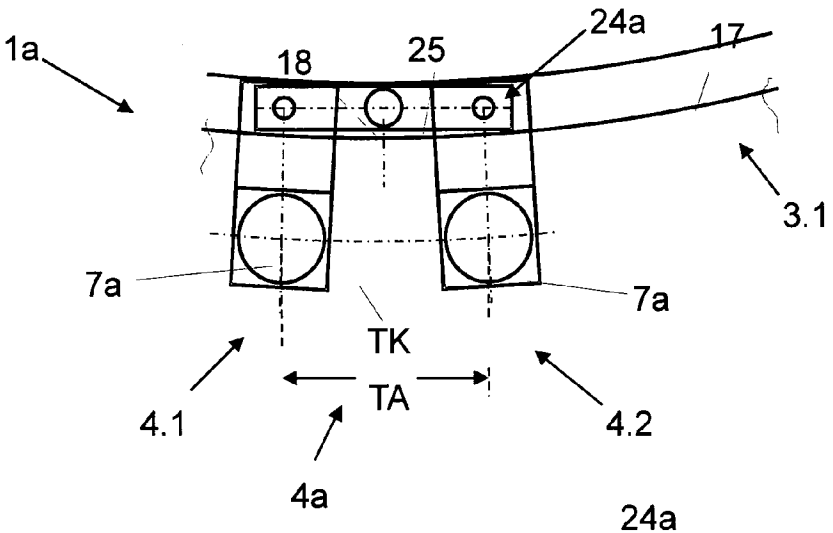
FIG. 5 is a plan view of an embodiment of two filling points forming one filling-point pair.

FIG. 4 shows a cam follower 8 that interacts with a control cam that does not rotate with the rotor 3 and is part of a lifting device to raise the particular container carrier. In the illustrated embodiment, the cam follower 8, or the associated lifting device, is provided jointly for the two container carriers of each filling-point pair 4.

As shown in FIG. 4, each filling element 7 comprises a filling-element housing 9 in which a liquid channel 10 is formed. The liquid channel 10 connects to a product pipe 11 that leads to a common tank 12 on the rotor 3 for supplying liquid filling-material to the filling points 4.1, 4.2. During the filling process, liquid filling-material at least partially fills the common tank 12.

On the underside of each filling-element housing 9, the liquid channel 10 forms an annular dispensing opening 13 for dispensing liquid filling-material into a bottle. Inside the liquid channel 10 is a liquid valve 14 with a valve body. Moving the valve body axially along the vertical filling element axis FA opens and closes the liquid valve 14 and controls the dispensing of the liquid-filling material through the dispensing opening 13 and into a bottle 2. A pneumatic actuation device 15 causes this movement.

The filling machine 1 defines an aseptic space 16 through which the open mouths of bottles 2 move during the filling process. This aseptic space 16 is separated from by walls, among which is a top wall formed by a disc-type pipe element 3.2 bearing the annual rotor element 3.1. The filling elements 7 are fitted on an outer surface of the rotor element 3.1. Each filling element 7 has an upper portion and a lower portion. Only the lower portion of the filling element 7 extends into the aseptic space 16.

Above the rotor element 3.2, and hence outside the aseptic space 16, are common annular chambers or channels 17 that provide fluid communication to all the filling points 4.1, 4.2. These channels 17 route process gases and/or provide a vacuum to all filling points 4.1, 4.2 during the filling process. As shown in FIG. 4, the channels 17 are between the machine axis MA and the filling element axis FA.

Referring back to FIG. 2, each filling-point pair 4 has gas-path control-valves 18 that control flow through various external gas-paths 20, each of which has a first gas-path section 20.1 and a second gas-path section 20.2. The control valves 18 thereby provide control over the various phases of the particular filling process. These gas-path control-valves 18 are provided jointly for the two filling elements 7 of each filling-point pair 4. The gas-path control-valves 18 are also controlled jointly.

The external gas-paths 20 are outside the filling-element housings 9. There are also internal gas-paths 19 inside the filling-element housings 9. However, these internal gas-paths 19 are uncontrolled because there are no gas-path control-valves inside the filling-element housing 7. At least one external gas-path 20 connects to the associated internal gas-paths 19 of the two filling elements 7 of each filling-point pair 4. The gas-path control-valve 18 is arranged in an external gas-path 20. As a result, controlling the gas-path control-valve 18 provides simultaneous control over both filling elements 7 of a particular filling-point pair 4.

In the illustrated embodiment, the gas-path control-valves 18 for a filling-point pair 4 are preferably pneumatically actuated valves that are part of a valve block 21 comprising multiple electrically controlled pneumatic valves. A central machine-controller 22 controls these valves.

The valve block 21 also provides control for opening and closing the liquid valves 14 in each of the filling elements 7. It does so based at least in part on how much liquid filling-material has flowed into the bottles 2 during the filling phase. A flow meter 23 shown in FIG. 2 measures this amount and sends a suitable signal back to the central machine-controller 22. In some embodiments, the flow meter 23 is a magnetic induction flow meter. As long as the filling elements 7 are designed with sufficient precision, their filling behavior will be essentially identical. Therefore, each filling-point pair 4 will require only one flow meter 23. This flow meter 23 can be placed in a product pipe 11 that supplies either one of the two filling elements 7.

The gas-path control-valves 18 and first gas-path section 20.1 of each external gas-path 20 of the particular filling-point pair are part of a control module 24, which is shown with a dashed line surrounding it in FIG. 2. In the illustrated embodiment, for each filling-point pair 4, there is a separate control module 24 on the top face of the rotor element 3.1.

As shown in FIG. 4, each control module 24 includes a block or module housing 25 that encloses both the first gas-path section 20.1 of the external gas-path 20 and the gas-path control-valve 18 that controls the external gas-path 20.

Meanwhile, the second gas-path section 20.2 of the external gas-path 20 is formed in the rotor element 3.1. This second gas-path section 20.2 is what opens into the annular chambers 17 and also into an internal gas-path 19 of the filling elements 7. In the illustrated embodiment, the second gas-path section 20.2 of the external gas-path 20 is not controlled. This means that there are no gas-path control-valves in the second gas path section 20.2.

Figure 3:
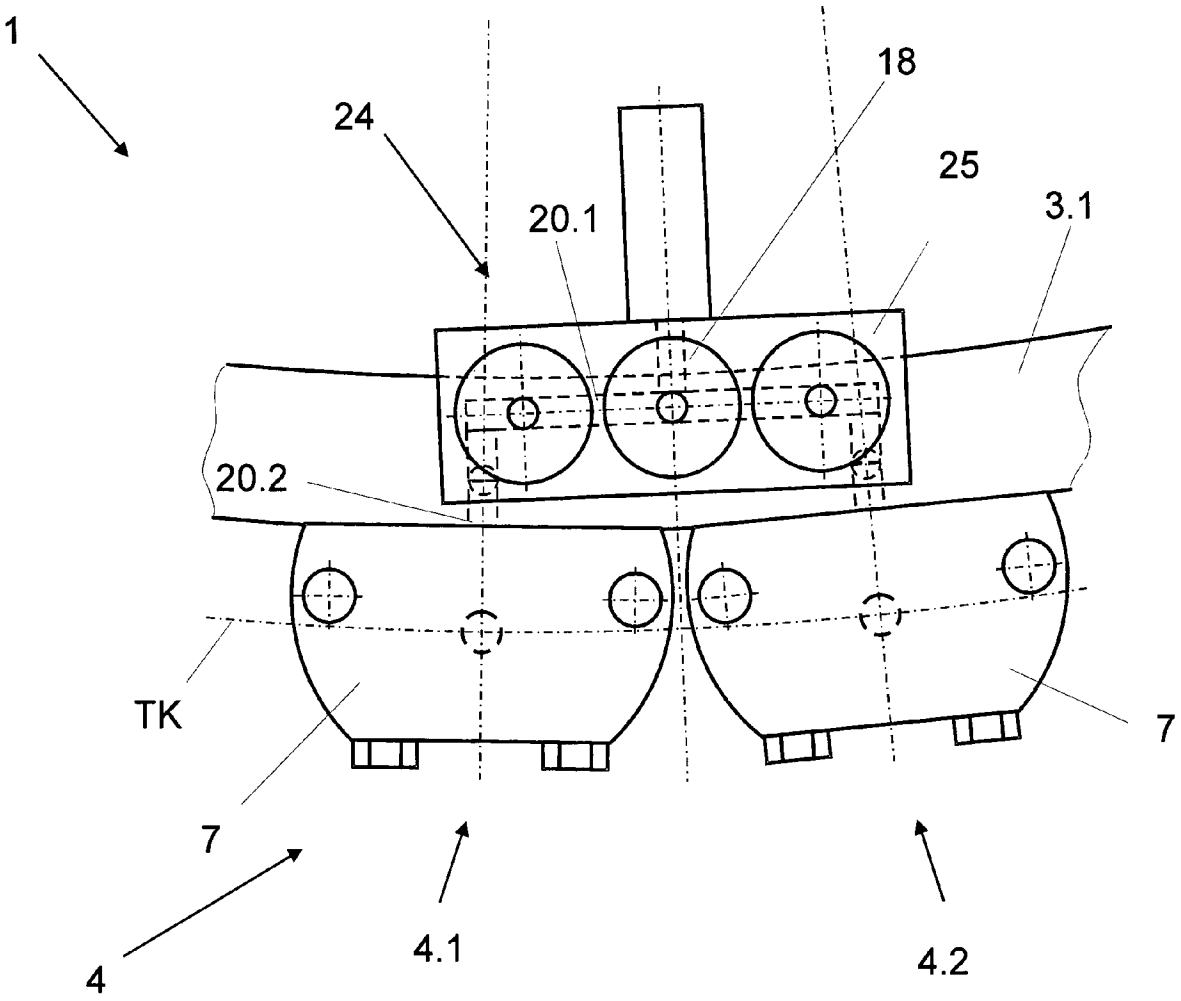
FIG. 3 is a view from above two filling elements of a filling-point pair parallel to a vertical machine axis.

As can be seen in FIGS. 3 and 4, the control modules 24 lie between the machine axis MA and the filling element axes FA. The control modules 24 are thus located inside the pitch circle TK. This places them inside the movement path of the filling elements 7.

The foregoing design results in a modular architecture in which filling-point pairs 4 and control modules 24 can be readily interchanged. This modular structure allows simple replacement of defective components. For example, if a filling element 7 or control module 24 goes bad, all one has to do is swap it out for a new one. Moreover, the modular structure also allows specially-made filling elements 7 for special filling processes to be assembled with a standard control module 24, or conversely, to use non-standard control modules 24 with standard filling elements 7. As a result, it becomes possible for the first time to have a filling machine 1 in which one can mix and match control modules 24 and filling-point pairs 4 with abandon.

Figure 6:
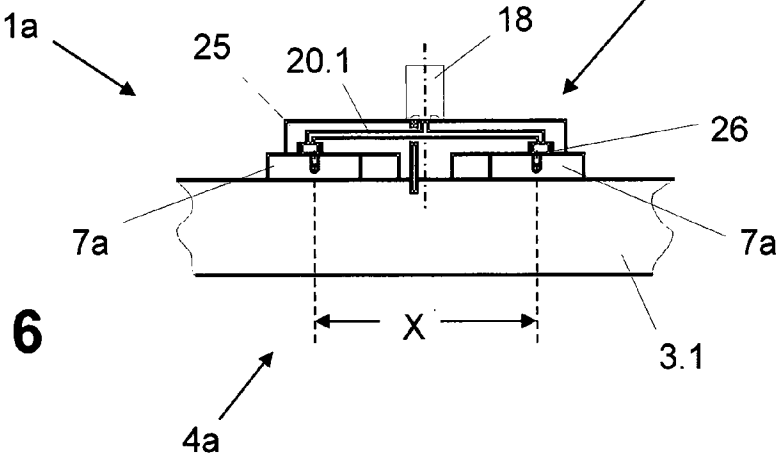
FIG. 6 is a side view of the filling points shown in FIG. 5.
Figure 7:
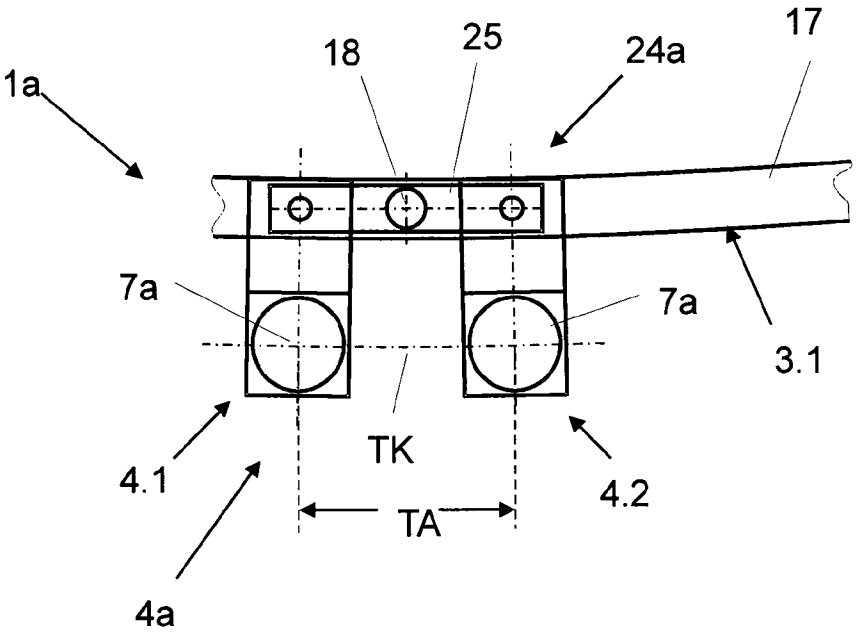
FIG. 7 is a plan view of another embodiment of two filling points forming one filling-point pair.
Figure 8:
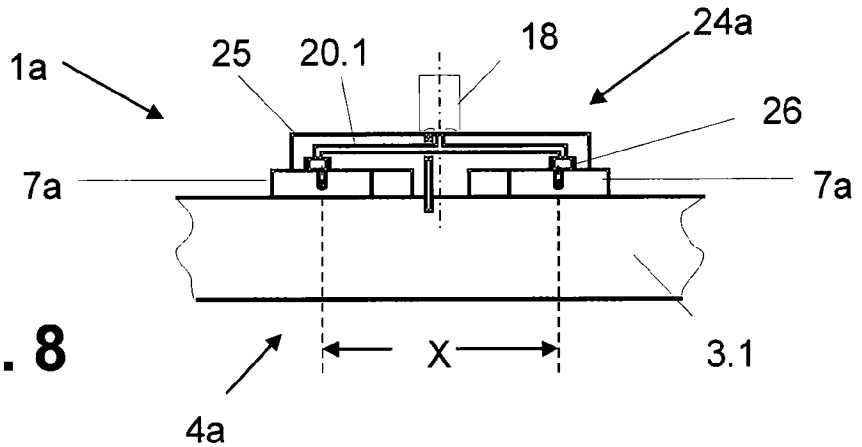
FIG. 8 is a side view of the filling points shown in FIG. 7.

FIGS. 5-9 show the rotor 3 of a filling machine 1*a* together with two filling points 4.1, 4.2 that form a filling-point pair 4*a*. FIGS. 6 and 7 show a view from above, while FIGS. 6 and 8 show a side view in which the filling elements 7*a* of the filling points 4.1 and 4.2 are only partially indicated.

The filling elements 7*a* are arranged with their filling element axes FA spaced apart by a division spacing TA on a pitch circle TK. The difference between FIGS. 5 and 6 and FIGS. 7 and 8 is the radius of the pitch circle TK. In particular, the pitch circle TK in FIGS. 5 and 6 has a smaller radius than the pitch circle TK in FIGS. 7 and 8. This difference can be readily ascertained by noticing the difference in curvature in FIGS. 5 and 7.

Figure 9:
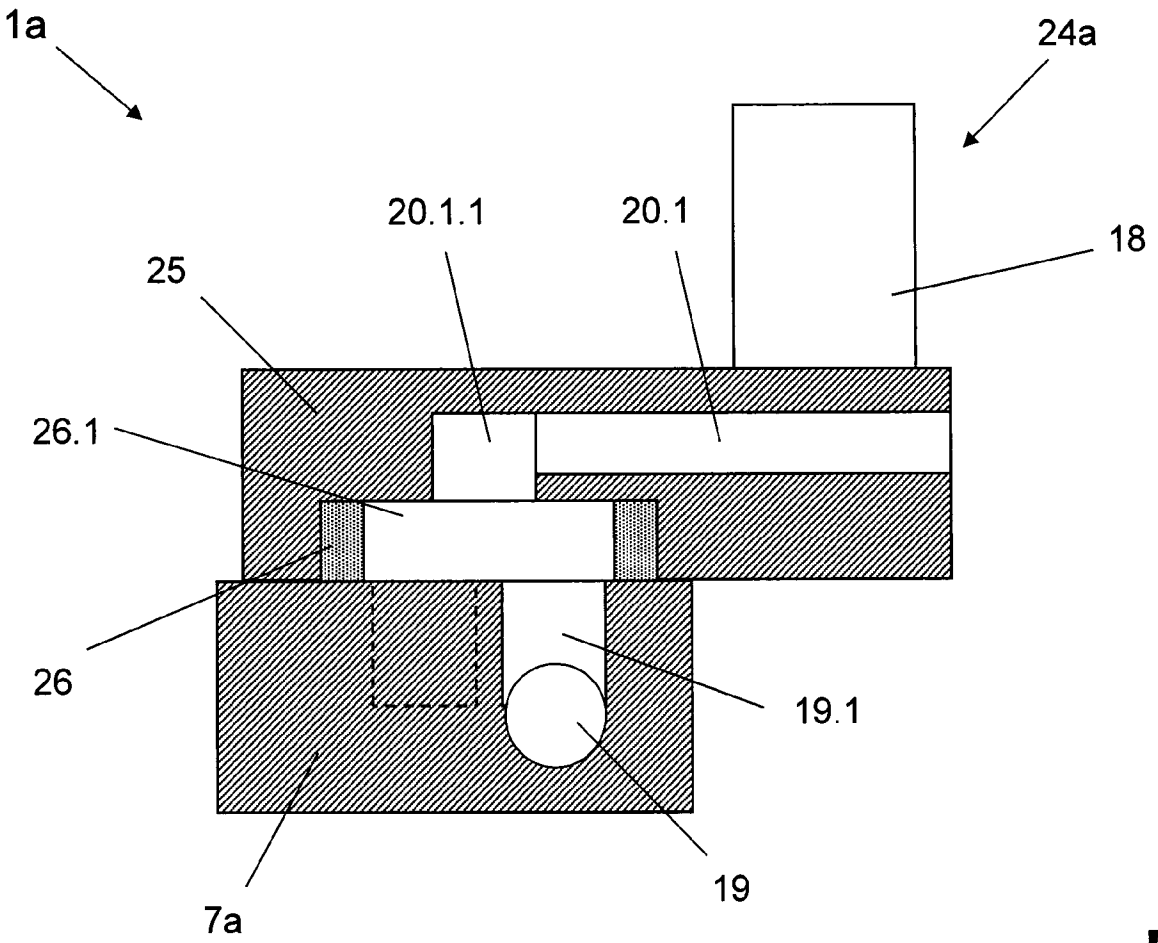
FIG. 9 shows an interface between the inner and outer gas channels in the filling-point pairs of FIGS. 5-8.

In the filling machine 1*a*, the openings in the control modules 24*a* must be made to mate with corresponding openings in a filling element 7*a*. Referring to FIG. 9, this is carried out by providing the control module 24*a* with a housing 25 having a level underside that is oriented in a plane perpendicular to the machine axis MA. Similarly, the filling element 7*a* has a mating surface that is oriented in a plane perpendicular to the machine axis MA. This area of the filling element 7*a* is radially offset so that it can mate with the level underside of the housing 25.

When the mating surface of a filling element 7*a* contacts the level underside of the housing 25, a mouth opening 20.1.1 of the first gas-path section 20.1 of the external gas-path 20 connects to a corresponding mouth opening 19.1 of an internal gas-path 19 of the filling element 7*a*. A seal 26 completes the connection so that gas can flow without loss between the control module 24*a* and the filling element 7*a*.

The seal 26 has a seal opening 26.1 that is somewhat larger than necessary. As shown in FIG. 9, the seal opening 26.1 is quite a bit larger than either mouth opening 20.1.1, 19.1. This makes it possible to maintain the same division spacing TA across pitch circles TK of different radii, as shown in FIGS. 5-8. As a result, it is possible to do more than just swap control modules and filling elements in and out of a particular filling machine 1 with a particular rotor 3. It is also possible to take a control module and filling element that fits a rotor having one radius and move them to a rotor that has a different radius.

Referring to FIGS. 6 and 8, one can see that a distance X changes due to a change in the pitch circle size. However, because the seal opening 26.1 is so much larger than the connection opening 19.1, this does not matter. All that will happen is that the connection openings 19.1, 20.1.1 will be at different relative positions. They will still both open in to the chamber defined by the seal 25. As a result, compensation for variations in the distance X is possible up to a measurement that is double the difference of the lineal dimensions of the seal opening 26.1 and the mouth opening 19.1.

For different division spacing TA of the filling points 4.1 and 4.2, i.e. for different axial distances between the filling elements 7*a* forming these filling points 4.1, 4.2 on the circumference of the rotor 3, it is necessary to provide control modules 24*a* for which the axial distance of the connection openings 20.1.1 has been adapted to the particular division spacing TA.

Having described the invention, and a preferred embodiment thereof, what is claimed as new, and secured by Letters Patent is:

1. An apparatus for processing containers, said apparatus comprising a modular filling-system for filling containers with liquid filling-material, wherein said modular filling-system comprises a plurality of filling-point pairs and stand-alone control-modules, said filling-point pairs and said stand-alone control-modules having a modular architecture that permits said stand-alone control-modules and filling-point pairs thereof to be interchanged, wherein each filling-point pair comprises filling points, each of which includes a filling element that comprises a filling-element housing, a liquid channel that is formed within said filling-element housing and that ends in a dispensing opening, and a liquid valve that controls flow of liquid filling-material through said dispensing opening and into a container that is to be filled, wherein each filling-point pair comprises an internal gas-path that is internal to a filling element of said filling-point pair and a first section of an external gas-path, the first section being external to any filling element of said filling-point pair and being common to both filling elements in said filling-point pair, wherein a stand-alone control module from said plurality of stand-alone control modules connects to said filling-point pair to form said external gas-path, wherein said stand-alone control module comprises a control-module housing within which is formed a second section of said external gas-path, wherein when connected to said first section, said second section completes said external gas-path, wherein, when said stand-alone control module is connected to said filling-point pair to complete said gas-path, a gas-path control-valve is disposed along said second section of said external gas-path, and connects to said internal gas path, whereby, as a result of said modular architecture, said stand-alone control module is interchangeable.

2. The apparatus of claim 1, further comprising a transport element having an outer surface on which said filling elements are disposed, wherein a section of said external gas-path is formed on said transport element, wherein gas flow through said section is uncontrolled.

3. The apparatus of claim 2, wherein said section of said external gas-path that is formed on said transport element opens into internal gas-paths of multiple filling elements.

4. The apparatus of claim 2, wherein said section of said external gas-path that is formed on said transport element opens into channels provided in said transport element, said channels being common to multiple filling elements.

5. The apparatus of claim 1, further comprising a transport element, wherein said stand-alone control-modules are arranged on an annular surface of said transport element.

6. The apparatus of claim 1, wherein said external gas-path opens directly into said internal gas-path.

7. The apparatus of claim 6, further comprising first and second openings, wherein said first opening is an opening of said external gas-path, wherein said second opening is an opening of said internal gas-path, and a seal, wherein said seal has a cross-sectional area having a first value, wherein said first opening has a cross-sectional area having a second value, wherein said second opening has a cross-sectional area having a third value, wherein said first and second openings define an interface for fluid communication between said external gas-path and said internal gas- path, wherein said seal seals said interface, wherein said first value is greater than said second value, and wherein said third value is less than said first value.

8. The apparatus of claim 1, further comprising a transport element that forms a partition that defines a first region and a second region, wherein said second region is an aseptic space for sterile filling of containers passing therethrough with liquid filling-material, wherein each of said filling elements comprises a first portion and a second portion, wherein said dispensing opening is at said second portion, wherein only said second portion extends into said aseptic space, wherein said stand-alone control-module is disposed on said partition in said first region, and wherein said gas-path control-valves are disposed on said partition in said first region.

9. The apparatus of claim 1, wherein said filling elements are spaced apart by a fixed distance, wherein said stand-alone control-module and said filling elements are configured to be mounted on a rotor that defines first and second concentric pitch circles having corresponding first and second radii that differ by no more than a specified value, and wherein said stand-alone control-modules are configured to be mounted along said first pitch circle and said filling elements are configured to be mounted along said second pitch circle.

10. The apparatus of claim 1, further comprising a rotor, wherein said filling-point pairs are mounted on said rotor radially offset from said control modules, which are also mounted on said rotor.

11. The apparatus of claim 1, wherein said filling elements are spaced apart by a fixed distance, wherein said stand-alone control-module and said filling elements are configured to be mounted on a rotor that defines first and second concentric pitch circles having corresponding first and second radii, said first radius being greater than said second radius, wherein said stand-alone control-modules are configured to be mounted along said second pitch circle and said filling elements are configured to be mounted along said first pitch circle.

12. The apparatus of claim 1, wherein said control-module housing comprises a level underside that defines a first plane that is perpendicular to a machine axis, wherein each of said filling elements comprises a mating surface that defines a second plane that is perpendicular to said machine axis.

13. The apparatus of claim 1, further comprising a rotor that rotates about a machine axis, wherein said control modules are on a top face of said rotor, wherein said control modules are between said machine axis and said filling-point pairs.

14. The apparatus of claim 1, further comprising a rotor that rotates about a machine axis, wherein said filling-point pairs move along a movement path, wherein said stand-alone control-modules are radially inside said movement path.

15. The apparatus of claim 1, further comprising further comprising first and second openings, wherein said first opening is an opening of said external gas-path, wherein said second opening is an opening of said internal gas-path, and wherein said control module and said filling-point pair are disposed such that said first and second openings are misaligned.

16. The apparatus of claim 1, wherein said filling-point pairs and said stand-alone control-modules are designed to fit a rotor having a first radius and wherein said stand-alone control-modules and said filling-point pairs are disposed on a rotor having a second radius that is different from said first radius.

17. The apparatus of claim 1, wherein said filling-point pairs and said stand-alone control-modules are designed to fit a rotor having a first radius, wherein each filling-point pair interfaces with a corresponding one of said stand-alone control-modules through a seal having a seal opening that engages a first mouth and a second mouth, wherein said first mouth is an opening of said external gas-path, wherein said second mouth is an opening of said internal gas-path, wherein said stand-alone control-modules and said filling-point pairs are disposed on a rotor having a second radius that is different from said first radius, and wherein said first and second radii differ by no more than double the difference between the lineal dimension of said seal opening and a lineal dimension of said first mouth.

18. The apparatus of claim 1, further comprising a transport element, wherein said filling elements are on said transport element, wherein said stand-alone control-modules are on said transport element, wherein said transport element conveys said filling elements along a first path having a first radius, wherein said transport element conveys said stand-alone control-modules along a second path having a second radius, wherein said first and second paths are concentric, and wherein said second radius is less than said first radius.

* * * * *